United States Patent [19]

Martin et al.

[11] 4,354,137

[45] Oct. 12, 1982

[54] INCANDESCENT LAMP HAVING SEAL-ANCHORED FILAMENT MOUNT, AND METHOD OF MAKING SUCH LAMP

[75] Inventors: Jack Martin, Paramus; Elam Pitkjaan, Cedar Grove, both of N.J.

[73] Assignee: Westinghouse Electric Corp., Pittsburgh, Pa.

[21] Appl. No.: 168,999

[22] Filed: Jul. 15, 1980

[51] Int. Cl.[3] ..... H01K 1/18

[52] U.S. Cl. ..... 313/222; 313/315

[58] Field of Search ..... 313/222, 315

[56] References Cited

U.S. PATENT DOCUMENTS

| | | | |
|---|---|---|---|
| 3,211,943 | 10/1965 | Cardwell | 313/222 X |
| 3,445,713 | 5/1969 | Cardwell | 313/273 |
| 3,496,401 | 2/1970 | Dumbaugh | 313/221 |
| 3,544,830 | 12/1970 | George et al. | 313/271 |
| 3,588,315 | 6/1971 | Levand | 313/317 X |
| 3,641,386 | 2/1972 | Audesse et al. | 313/179 |
| 3,648,094 | 3/1972 | De Caro et al. | 313/221 |
| 3,668,391 | 6/1972 | Kimball | 313/318 |
| 3,829,729 | 8/1974 | Westlund et al. | 313/174 |
| 4,005,324 | 1/1977 | Dolenga et al. | 313/222 |

FOREIGN PATENT DOCUMENTS

| | | | |
|---|---|---|---|
| 2752051 | 6/1978 | Fed. Rep. of Germany | 313/222 |

*Primary Examiner*—Robert Segal

*Attorney, Agent, or Firm*—D. S. Buleza

[57] ABSTRACT

The envelope of a compact halogen-cycle incandescent lamp is made from hard glass and the uncoiled legs of the tungsten filament are used as filament connector-support members by fastening them directly to flattened ends of a pair of single lead wires and embedding the resulting electrical junctures in the hermetic seal of fused glass which is formed on the end of the envelope. The lead wires originally comprise the legs of a hairpin-shaped wire member which permits the filament-mount to be made and handled as a separate subassembly. The U-bent part of the hairpin-shaped wire member is severed and removed after the mount has been sealed into the envelope to provide the required pair of separate lead wires.

11 Claims, 11 Drawing Figures

INCANDESCENT LAMP HAVING SEAL-ANCHORED FILAMENT MOUNT, AND METHOD OF MAKING SUCH LAMP

BACKGROUND OF THE INVENTION

This invention generally relates to electric incandescent lamps and has particular reference to an improved filament mount and seal-embedded electrical juncture for an incandescent lamp of the halogen-cycle type, and to a method of manufacturing electric lamps having such mount assemblies and electrical junctures.

Halogen-cycle incandescent lamps are well known in the art and utilize a halogen, such as bromine or iodine, within the envelope which returns vaporized tungsten material to the filament and thus prevents the envelope walls from progressively blackening and drastically reducing the light output of the lamp during its useful life. Due to the high bulb-wall temperatures involved and the use of a halogen-containing atmosphere, the lamp envelope is made from quartz or a hard glass (such as borosilicate or aluminosilicate glass) that has a high melting point. In order to insure the integrity of the hermetic seal which joins the envelope to the lead-in conductors, the standard practice in the prior art was to connect the outer lead wires to the ends of the tungsten filament (or to a pair of inner lead wires) with ribbon-like conductors such as molybdenum foil or the like that are embedded in the fused mass of quartz or glass which comprises the sealed end of the lamp envelope. A tungsten-halogen incandescent lamp which employs both of the foregoing structural arrangements is disclosed in FIGS. 1–4 of U.S. Pat. No. 3,588,315, issued June 18, 1971 to Levand, Jr. et al. A halogen incandescent lamp having a filament with legs of coiled tungsten wire that are connected to ribbon conductors and partly embedded in the envelope seal is disclosed in U.S. Pat. No. 3,668,391 to Kimball. It is also well known in the art to connect the coiled filament of a compact halogen-cycle incandescent lamp to the outer lead wires by flattening the seal-embedded ends of the latter and joining them to inner lead wire components that are secured to the legs of the filament coil. A halogen-cycle incandescent lamp constructed in this manner is disclosed in U.S. Pat. No. 3,445,713, issued May 20, 1969 to Cardwell, Jr.

A tungsten-halogen type incandescent lamp having an envelope that is composed of hard glass (such as aluminosilicate glass) instead of quartz and which employs a pair of one-piece lead-in wires that extend from the coiled filament through and beyond the press-sealed end of the envelope is described in U.S. Pat. No. 3,829,729, issued Aug. 13, 1974 to Westlund, Jr. et al. This patent also discloses that U.S. Pat. No. 3,641,386 to Audesse et al. describes a halogen incandescent lamp that employs a borosilicate glass envelope. U.S. Pat. No. 3,648,094 to DeCaro et al. also discloses a halogen-cycle lamp that has a borosilicate glass envelope.

U.S. Pat. No. 3,544,830 to George et al. discloses a method of making a filament-mount assembly for a quartz-halogen lamp using a U-shaped lead-wire support member and a pair of ribbon conductors that are subsequently embedded in the press-sealed end of the envelope after the U-shaped support member is severed.

Since the electrical junctures between the lead-in wires and the filament of such incandescent lamps are crucial in view of the fact that they obviously will render the lamp inoperative if the junctures fail, it is important that such junctures be made as strong and as reliable as possible. This is especially important in the case of compact halogen-cycle type incandescent lamps that are used as the inner light sources in sealed-beam headlamps insofar as such lamps are inherently subjected to severe rough service conditions when the headlamp is in use on the motor vehicle.

It would accordingly be very desirable to provide a simple but very reliable arrangement for electrically connecting the filament of a compact incandescent lamp with the lead-in conductors which not only improves the lamp quality but facilitates manufacture of the lamp and reduces its cost, and to effect the electrical junctures in such a manner that the filament mount and its electrical connections are rugged enough to withstand the mechanical shocks and vibrations encountered during the life of the lamp.

SUMMARY OF THE INVENTION

All of these objectives are achieved in accordance with the present invention by fabricating the coiled tungsten filament in such a way that it has a pair of uncoiled leg portions of such length that they laterally extend from the coiled body of the filament into the hermetic seal of fused-glass formed on the end of the lamp envelope where they are electrically joined to the ends of a single pair of lead-in wires. The electrical junctures formed by these components are so arranged that they are at least partly or entirely embedded within the fused-glass seal. The need for separate interconnecting ribbon-like conductors and a second set of inner lead-in wires is thus eliminated since the coil legs are connected directly to the outer lead wires and thus serve as connector-support members for the coiled body portion of the filament. In the case of a halogen-cycle type incandescent lamp, the outer lead wires are composed of molybdenum which effects a durable heremetic seal with the hard glass envelope (preferably an envelope made from aluminosilicate type glass) and the filament legs are joined to the leads by brazed junctions effected by an intervening layer of a flux-like metal consisting of platinum or platinum-coated molybdenum.

The manufacture of the filament mount is further facilitated by utilizing a hairpin-shaped lead wire member that is joined to the coil legs and optionally provided with beads of fused glass to provide an integral subassembly that can be readily handled and sealed into the lamp envelope, after which the U-bent portion of the lead wire member is severed and removed to provide the desired pair of separate leads.

BRIEF DESCRIPTION OF THE DRAWINGS

A better understanding of the invention will be obtained from the exemplary embodiment shown in the accompanying drawings, wherein.

DESCRIPTION OF THE PREFERRED EMBODIMENTS

While the present invention can be used with advantage in various kinds of incandescent lamps that utilize glass envelopes and are small enough to permit uncoiled leg portions of the coiled filament to be connected directly to the outer lead conductors and thus serve as connector-members for the filament, it is especially adapted for use in halogen-cycle type incandescent lamps that are currently being used as inner lamp components for sealed-beam headlamps and it has accordingly been so illustrated and will be so described.

Figure 1:
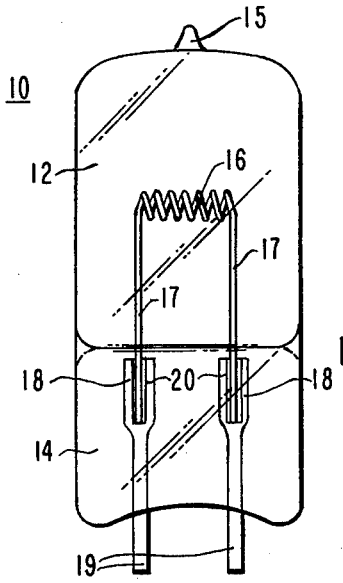
FIG. 1 is an enlarged elevational view of a compact halogen-cycle incandescent lamp that embodies the present invention.

A compact halogen-cycle incandescent lamp 10 of the foregoing type is shown in FIG. 1 and comprises a tubular envelope 12 of suitable hard glass (such as an aluminosilicate or borosilicate type glass) that contains a coiled filament 16. The envelope is terminated at one end by a press seal 14 of fused glass and at its opposite end by a sealed-off tip 15 which constitutes the residue of a tubulation through which the lamp is evacuated, charged with fill gas and dosed with a controlled amount of a suitable halogen such as iodine or bromine. In accordance with the present invention, the coiled filament 16 is wound from refractory metal wire in such a way that it has two uncoiled leg portions 17 that extend laterally from the coiled body of the filament and are disposed in substantially side-by-side relationship. The ends of the filament leg portions 17 extend into the fused-glass seal 14 and are fastened (as by welding) to flattened ends 18 of a pair of lead-in wires 19 that are also embedded in the glass seal. The coiled body of the filament 16 extends transversely with respect to the longitudinal axis of the lamp 10.

In the case of the halogen-cycle type automotive incandescent lamp here illustrated, the coiled filament 16 is composed essentially of tungsten and the lead-in wires 19 are preferably composed of molybdenum and fastened to the ends of the tungsten filament legs 17 by brazed junctions that are formed by layers 20 of suitable flux-like metal (such as a thin strip of melted platinum foil or platinum-coated molybdenum foil) which is located between the overlapped parts of the coil legs and lead-in wires. The brazed junctions are formed by simply placing the filament legs 17 in overlapped aligned position on the flattened ends 18 of the lead wires 19 with the strip of the flux-like foil interposed between the components, and then subjecting the assembled parts to a welding operation which heats them to a sufficient temperature to fuse the members together and form a brazed joint that includes the melted layer 20 of the flux-like metal. However, if the welding current and pressure are properly controlled, then the juncture can be made by welding the coil leg directly to the flattened end of the lead wire without using any flux-like material so that a welded joint is made even though tungsten and molybdenum members are involved.

Since aluminosilicate type glass has a coefficient of thermal expansion that closely matches that of molybdenum and tungsten, the envelope 12 is preferably made from this type of glass to insure that a reliable hermetic bond is effected between the sealed end 14 of the envelope and the embedded parts of the lead-in wires 19 and coil legs 17. However, a borosilicate type glass can also be used.

As will be noted in FIG. 1, both of the electrical junctures resulting from the brazing of the ends of the filament legs 17 to the flattened ends 18 of the lead-in wires 19 is completely embedded and buried in the mass of fused glass that forms the press seal 14 so that the legs and lead wires are firmly anchored in the seal. This not only rigidifies the filament structure but protects the electrical junctures from the deleterious effects of vibrational forces, etc. that might gradually destroy the electrical connections when the lamp 10 is in use. It should be noted, however, that the electrical junctures do not have to be entirely embedded within the press seal 14 since the same structural and functional advantages will be obtained if only a portion of each juncture is embedded in the seal. The tips of the flattened ends 18 of the lead wires 19 and corresponding overlapped parts of the filament legs 17 can, accordingly, extend inwardly from the press seal 14 into the envelope 12 without departing from the spirit and scope of the invention as long as a sufficient portion of the brazed end of each of the coil legs 17 is embedded and anchored in the seal along with the joined and adjacent parts of the lead wires 19. The hermetic seal between the press seal 14 and lead wires 19 is made with the unflattened medial parts of the wires that are embedded in the fused glass.

As shown in FIG. 1, the lead-in wires 19 are of sufficient length that they protrude beyond the end of the press seal 14 and thus serve as terminals for connecting the lamp 10 to an electrical power source.

Figure 2A:
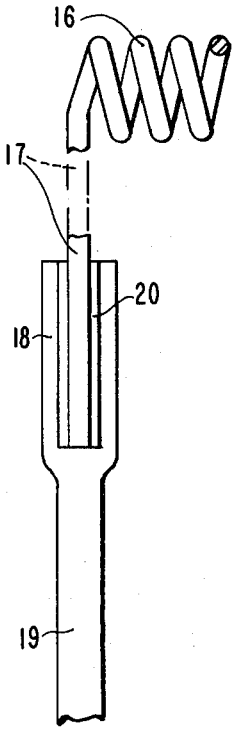
FIGS. 2A and 2B are fragmentary front and side elevational views, on an even larger scale, of one of the filament leg and lead wire junctures showing the structural features in greater detail.
Figure 2B:
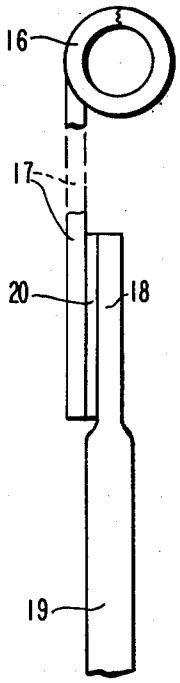

As will be noted in FIGS. 2A and 2B, the molybdenum lead-in wires 19 are of circular cross-section and their flattened ends 18 are disposed in overlapped parallel relationship with the respective legs 17 of the filament 16 with the thin layer 20 of melted flux-metal foil disposed therebetween. As will also be noted in FIGS. 1 and 2B, the filament legs 17 are substantially aligned with one another in a common plane and the flattened lead wire ends 18 and press seal 14 are located in substantially coplanar relationship. The electrical junctures formed by the brazed ends of the filament legs 17 and lead wires 19 thus lie in side-by-side position within the press seal 14.

As a specific example, satisfactory results have been obtained in the case of a 50 watt 12.8 volt halogen-cycle lamp having a diameter of approximately 12 millimeters and an overall length of approximately 25 millimeters by winding the filament from tungsten wire approximately 0.16 millimeter in diameter and flattening the ends of molybdenum lead wires of approximately 0.6 millimeter into flat segments that measured from 2 to 3 millimeters long, 0.5 millimeter wide and approximately 0.3 millimeter thick. The lamp envelope was composed of aluminosilicate glass No. 1776 which was obtained from the Corning Glass Company and was filled with about 500 Torr of argon that contained approximately 0.2% by volume of methylene bromide which served as a source of bromine within the energized lamp.

Aluminosilicate glass No. 1776 is presently no longer marketed by Corning Glass Company. However, its sealing characteristics relative to molybdenum leads is similar to Corning glass No. 1720 which is also an aluminosilicate glass and can thus be used as a suitable substitute. Aluminosilicate type glasses are well known in the art as disclosed in U.S. Pat. No. 3,496,401 issued Feb. 17, 1970 to Dumbaugh, Jr., the teachings whereof as to such glasses are incorporated herein by reference. As indicated in this patent, an aluminosilicate glass that is especially suited for use as envelope material for halogen-cycle lamps contains from 10 to 25% (by weight) of an alkaline earth metal oxide (such as MgO, CaO, SrO, or BaO), from 13 to 25% alumina, from 55 to 70% silica, and from 0 to 10% $B_2O_3$ with substantially no alkali (soda or potash).

If the bulb-wall temperatures are not too high (below 550° C. or so) and lead wires are used which form a reliable hermetic seal with borosilicate type glasses, then such glasses can also be used as the envelope material. As a specific example, Corning Glass No. 7740 is a borosilicate glass (marketed under the trade name "Pyrex" glass) that has a softening temperature of around 820° C. and typically contains 80% (by weight) silica, 14% boron oxide, 4% sodium oxide and 2% alumina (as disclosed in DeCaro et al. U.S. Pat. No. 3,648,094).

FILAMENT-MOUNT MANUFACTURE (FIGS. 3A–3D)

Figure 3A:
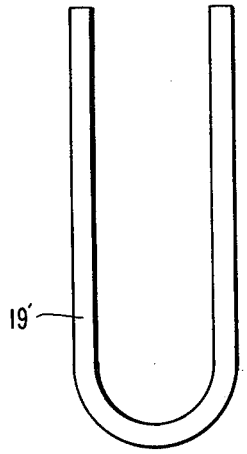
FIGS. 3A–3D are illustrations of the various steps involved in manufacturing the improved filament mount assembly in accordance with the invention.
Figure 3B:
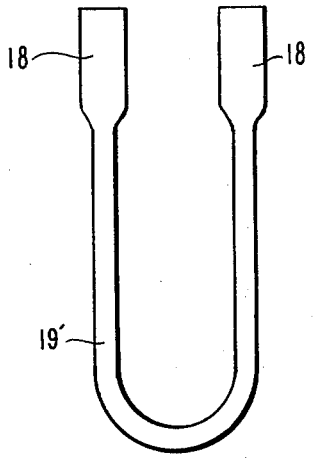

The tungsten filament and molybdenum lead-in wires can be readily joined together to form a separate subassembly, as shown in FIGS. 3A–3D. This is achieved by bending a piece of molybdenum wire of the proper diameter and length into a hairpin-shaped member 19' shown in FIG. 3A. The ends of this member are then compressed to form flattened segments 18 of the proper dimensions (FIG. 3B).

Figure 3C:
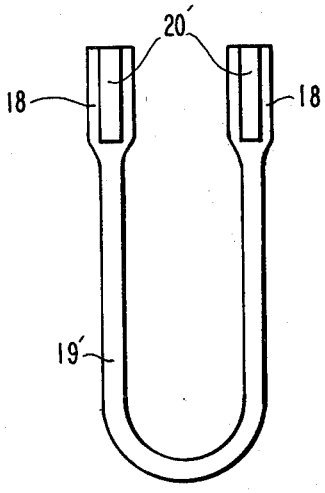
Figure 3D:
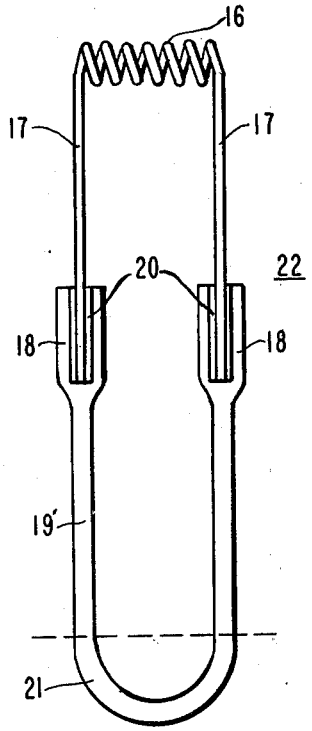

Thin strips 20' of the flux-like metal foil are then attached to the flattened ends 18 of the lead wire member 19', as shown in FIG. 3C, and the ends of the filament legs 17 are then brazed to the flattened lead wire segments 18 to form the filament-mount subassembly 22 shown in FIG. 3D. After the mount 22 is sealed into the envelope 12, the protruding U-bent portion 21 is severed along the dotted line (shown in FIG. 3D) to provide the required pair of separate lead wires for the finished lamp 10.

ALTERNATE FILAMENT-MOUNT ASSEMBLY (FIGS. 4A–4D)

An alternative form of filament-mount assembly and the manner in which it is manufactured is shown in FIGS. 4A–4D.

Figure 4A:
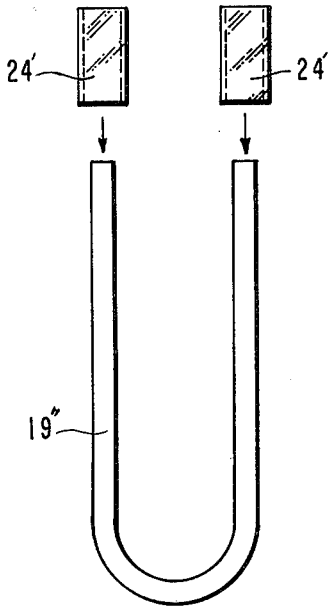
FIGS. 4A–4D are similar views of an alternate mount-manufacturing method wherein selected portions of the lead-in wires are provided with fused glass beads.
Figure 4B:
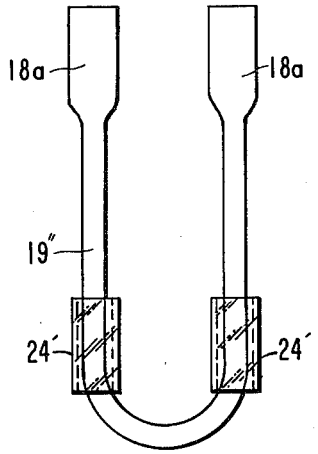
Figure 4C:
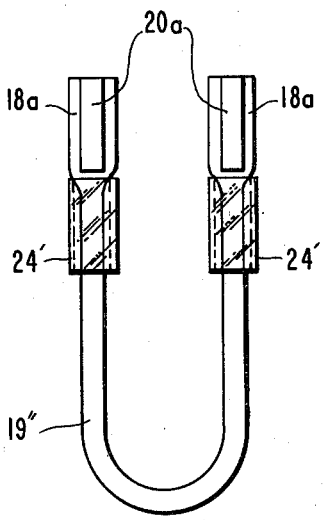
Figure 4D:
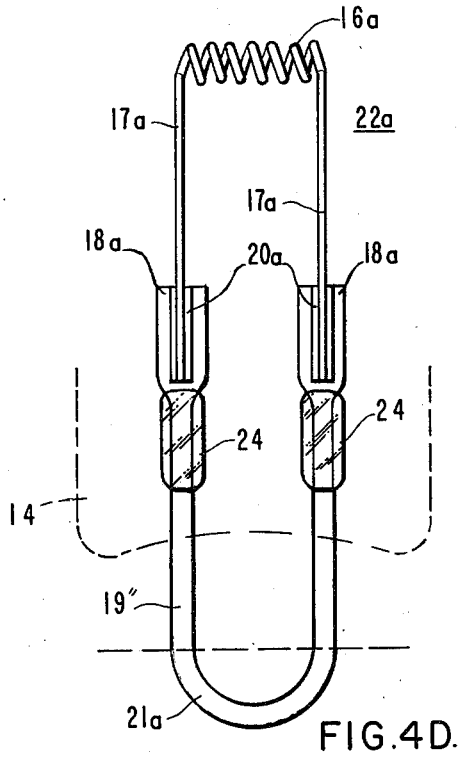

As in the previous embodiment, the first step (shown in FIG. 4A) comprises forming a hairpin-shaped lead-wire member 19'' from a piece of molybdenum wire of the proper diameter and length. A pair of snug-fitting sleeves 24' of aluminosilicate type glass (or other type of glass which matches that of the envelope or which forms a strong bond therewith and with the lead wires) is slipped over the ends of the member 19''. The flattened ends **18*a* are then formed on the lead-wire member 19'', as shown in FIG. 4B, and the flux-like strips 20*a* of metal foil are placed on the flattened ends to form the assembly shown in FIG. 4C. The glass sleeves 24' are then seated against the flattened ends 18*a* of the lead-wire component 19'' and subjected to suitable glass-working fires (not shown) to melt them and form a pair of beads. The formed beads 24 are shown in FIG. 4D along with the coiled filament 16*a* after it has been brazed to the flattened ends 18*a* of the lead-wire component 19'', thus forming the completed filament-mount assembly 22*a*. As will be noted by the profile of the press seal 14 (shown in phantom), the beads 24'** are so located that they merge and fuse with the press seal and thus facilitate the sealing-in operation.

As in the previous embodiment, the U-bent portion **21*a* of the lead-wire component 19'' is severed after the mount 22*a* is sealed within the envelope 12** to provide the required pair of separate lead wires.

As will be understood by those skilled in the art, the invention is not limited to compact halogen-cycle incandescent lamps that contain a single filament coil but includes within its scope such lamps that contain two or more filaments (with legs that form seal-embedded electrical junctures) and which also can contain light shields and other elements that are secured to the mount structure or envelope seal.

The invention is also not limited to halogen-cycle type lamps per se but can be used in standard small-size incandescent lamps that do not contain a halogen. Of course, the envelope will have to be made from a glass which has a thermal expansion characteristic such that it effects a reliable hermetic seal with the particular type of metal lead-in conductors that are used.

We claim as our invention:

1. In an electric incandescent lamp that has a glass envelope which is terminated at one end by an hermetic seal of fused glass, the improvement comprising the combination of;

a refractory wire filament having a coiled body and a pair of uncoiled leg portions the ends whereof are substantially disposed in side-by-side relationship, and a pair of lead-in wires that have flattened end portions which are fastened to the ends of the filament leg portions by a welded juncture or a brazed junction and thus form electrical junctures that are devoid of separate interconnecting conductor members, the uncoiled leg portions of said filament being of such length that at least a part of each of the electrical junctures is embedded in the fused-glass seal so that said leg portions are securely anchored in the seal and thus serve as electrical-connector members and the sole mechanical-support means for the coiled body of the filament, the lead-in wires being of such length that the free ends thereof protrude from the sealed end of the envelope.

2. The incandescent lamp of claim 1 wherein;

the filament is essentially composed of tungsten, the lead-in wires are composed of molybdenum and the welded juncture or brazed junction which connects the lead-in wires to the associated ends of the filament leg portions includes an interposed layer of flux-like metal from the group consisting of platinum and platinum-coated molybdenum.

3. The electric incandescent lamp of claim 1 wherein;

the coiled filament is essentially composed of tungsten and the envelope contains a halogen which provides a halogen cycle within the energized lamp that returns vaporized tungsten to the filament, and said envelope is composed of hard glass.

4. The halogen-cycle incandescent lamp of claim 3 wherein;

the fused-glass seal comprises a press seal of substantially planar configuration, the parts of the lead-in wires that are fastened to the filament leg portions are flattened and disposed in overlapped relationship with the ends of the associated leg portions, and the flattened parts of the lead-in wires are disposed in substantially coplanar relationship with the press seal.

5. The halogen-cycle incandescent lamp of claim 3 or 4 wherein;

said lead-in wires are composed of molybdenum, and the ends of the filament leg portions are fastened to the lead-in wires by a welded juncture or a brazed junction that includes an interposed layer of flux-like metal from the group consisting of platinum and platinum-coated molybdenum.

6. The halogen-cycle incandescent lamp of claim 3 wherein;

the envelope is composed of aluminosilicate type or borosilicate type glass, and the halogen within the envelope comprises bromine.

7. In the manufacture of an incandescent lamp that has a glass envelope which is adapted to be closed at one end by an hermetic seal that is formed by fusing and collapsing an end portion of the envelope, the method of first fabricating a filament-mount assembly for the lamp that can be handled as a separate component and then subsequently sealing said assembly into the envelope, which method comprises;

bending a piece of lead-in wire material into a hairpin-shaped member, flattening the free ends of said lead-in wire member, forming a filament having a coiled body and laterally-extending uncoiled leg portions and fastening the ends of said leg portions to the flattened ends of the lead-in wire member to provide electrical junctures that hold the lead-in wire member and filament in operative relationship and thus produce a filament-mount assembly, inserting the filament-mount assembly into the envelope and positioning said assembly in a manner such that the electrical junctures are so located relative to the end portion of the envelope that they are at least partly embedded within the hermetic seal of fused glass when the said end portion of the envelope is fused and collapsed onto and joined to the assembly during the sealing-in operation, and then severing the U-bent portion of the hairpin-shaped lead-in wire member to provide the required pair of separate lead-in wires for the lamp.

8. The method of claim 7 wherein the filament legs are fastened to the flattened ends of the lead wire member by a brazed junction.

9. The method of claim 7 wherein;

a glass sleeve is slipped over each of the legs of the hairpin-shaped lead wire member, before the ends thereof are flattened, and, said sleeves are subsequently melted to form glass beads that cover parts of the lead wire member that are adjacent to the respective flattened ends thereof.

10. The electric incandescent lamp of claim 1 or 3 wherein;

the coiled body of said filament is disposed transverse to the longitudinal axis of the lamp and the uncoiled filament leg portions extend laterally from the coiled body, and the filament leg portions are of such length that the electrical junctures formed by the fastened ends of the filament leg portions and associated lead-in wires are entirely embedded in the fused-glass seal.

11. The electric incandescent lamp of claim 10 wherein;

said envelope is of tubular configuration, and the fused-glass seal comprises a press seal of such configuration and size that medial parts of each of said lead-in wires are also embedded in and hermetically joined to the fused-glass seal.

* * * * *